US009385411B2

(12) United States Patent
Ohashi et al.

(10) Patent No.: US 9,385,411 B2
(45) Date of Patent: Jul. 5, 2016

(54) DIRECTIONAL COUPLER

(71) Applicant: TDK CORPORATION, Tokyo (JP)

(72) Inventors: Takeshi Ohashi, Tokyo (JP); Yukio Mitake, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/606,339

(22) Filed: Jan. 27, 2015

(65) Prior Publication Data

US 2015/0263406 A1 Sep. 17, 2015

(30) Foreign Application Priority Data

Mar. 12, 2014 (JP) ..... 2014-049003

(51) Int. Cl.
*H01P 5/18* (2006.01)
*H01P 3/08* (2006.01)

(52) U.S. Cl.
CPC ..... *H01P 5/187* (2013.01)

(58) Field of Classification Search
CPC ..... H01P 5/18; H01P 3/08
USPC ..... 333/109, 110, 111, 112, 116
See application file for complete search history.

(56) References Cited

U.S. PATENT DOCUMENTS 7,218,186 B2 * 5/2007 Chen ..... H01P 5/185 333/116
7,907,032 B2 * 3/2011 Yamamoto ..... H01P 5/18 333/116
2012/0161897 A1 6/2012 Tamaru et al.
2012/0319797 A1 12/2012 Tamaru
2013/0300518 A1 * 11/2013 Tamaru ..... H01P 5/18 333/109

* cited by examiner

*Primary Examiner* — Dean Takaoka
(74) *Attorney, Agent, or Firm* — Oliff PLC

(57) ABSTRACT

A directional coupler includes a main line and a subline. The main line connects an input port and an output port. The subline connects a coupling port and a terminal port. The subline includes a first coupling line section connected to the terminal port, a second coupling line section connected to the coupling port, and a low-pass filter. The low-pass filter includes an inductor provided between the first and second coupling line sections, a first capacitor having an end connected to the connection point between the inductor and the second coupling line section, a resistor connecting the other end of the first capacitor to the ground, and a second capacitor connecting the connection point between the inductor and the first coupling line section to the ground.

5 Claims, 14 Drawing Sheets

DIRECTIONAL COUPLER

BACKGROUND OF THE INVENTION

1. Field of the Invention

The present invention relates to a wideband capable directional coupler.

2. Description of the Related Art

Directional couplers are used for detecting the levels of transmission/reception signals in transmission/reception circuits of wireless communication apparatuses such as cellular phones and wireless LAN communication apparatuses.

A directional coupler configured as follows is known as a conventional directional coupler. The directional coupler has an input port, an output port, a coupling port, a terminal port, a main line, and a subline. The main line has a first end connected to the input port and a second end connected to the output port. The subline has a first end connected to the coupling port and a second end connected to the terminal port. The main line and the subline are configured to be electromagnetically coupled to each other. The terminal port is grounded via a terminator having a resistance of 50Ω, for example. The input port receives a high frequency signal, and the output port outputs the same. The coupling port outputs a coupling signal having a power that depends on the power of the high frequency signal received at the input port.

Major parameters indicating the characteristics of directional couplers include insertion loss, coupling, isolation, directivity, and return loss at the coupling port. Definitions of these parameters will now be described. First, assume that the input port receives a high frequency signal of power P1. In this case, let P2 be the power of the signal output from the output port, P3 be the power of the signal output from the coupling port, and P4 be the power of the signal output from the terminal port. Further, assuming that the coupling port receives a high frequency signal of power P5, let P6 be the power of the signal reflected at the coupling port. Further, let IL represent insertion loss, C represent coupling, I represent isolation, D represent directivity, and RL represent return loss at the coupling port. These parameters are defined by the following equations.

$$IL=10\log(P2/P1)[\text{dB}]$$

$$C=10\log(P3/P1)[\text{dB}]$$

$$I=10\log(P3/P2)[\text{dB}]$$

$$D=10\log(P4/P3)[\text{dB}]$$

$$RL=10\log(P6/P5)[\text{dB}]$$

The coupling of the conventional directional coupler increases with increasing frequency of the high frequency signal received at the input port, and thus has a non-flat frequency response. The conventional directional coupler therefore suffers from the problem of not being wideband capable. Where coupling is denoted as −c (dB), an increase in coupling means a decrease in the value of c.

U.S. Patent Application Publication Nos. 2012/0161897 A1 and 2012/0319797 A1 disclose directional couplers aiming to resolve the aforementioned problem. U.S. Patent Application Publication No. 2012/0161897 A1 discloses a directional coupler including first to fourth terminals, a main line connecting the first terminal and the second terminal, a subline provided between the third terminal and the fourth terminal, and a low-pass filter provided between the third terminal and the subline.

U.S. Patent Application Publication No. 2012/0319797 A1 discloses a directional coupler including first to fourth terminals, a main line connecting the first terminal and the second terminal, a first subline connected to the third terminal, a second subline connected to the fourth terminal, and a low-pass filter provided between the first subline and the second subline.

U.S. Patent Application Publication Nos. 2012/0161897 A1 and 2012/0319797 A1 each further disclose a directional coupler including first to fourth terminals, a main line connecting the first terminal and the second terminal, a subline provided between the third terminal and the fourth terminal, a first low-pass filter provided between the third terminal and the subline, and a second low-pass filter provided between the fourth terminal and the subline. The first low-pass filter is composed of a first inductor provided between the third terminal and the subline, and a first capacitor provided between the ground and the connection point between the subline and the first inductor. The second low-pass filter is composed of a second inductor provided between the fourth terminal and the subline, and a second capacitor provided between the ground and the connection point between the subline and the second inductor. The two U.S. publications each further disclose a directional coupler including two terminators, one between the first capacitor and the ground, the other between the second capacitor and the ground.

It is demanded of directional couplers for use in wireless communication apparatuses that signal reflection at the coupling port be reduced where the coupling port is connected with a signal source having an output impedance equal to the resistance (e.g., 50Ω) of the terminator connected to the terminal port. More specifically, it is demanded of the directional couplers that, where the return loss at the coupling port is denoted as −r (dB), the value of r be of sufficient magnitude in the service frequency bands of the directional couplers. An example of the cases where the coupling port is connected with the aforementioned signal source is where two directional couplers are connected in tandem for use. In such a case, the respective coupling ports of the two directional couplers are connected to each other.

Neither of U.S. Patent Application Publication Nos. 2012/0161897 A1 and 2012/0319797 A1 gives any consideration to reducing signal reflection at the coupling port where the coupling port is connected with a signal source having an output impedance equal to the resistance of the terminator connected to the terminal port. Further, for a directional coupler including a low-pass filter such as that disclosed in each of the above two U.S. publications, it is difficult to reduce signal reflection at the coupling port by simply adjusting the inductance of the inductor constituting the low-pass filter and the capacitance of the capacitor constituting the low-pass filter.

As previously mentioned, U.S. Patent Application Publication Nos. 2012/0161897 A1 and 2012/0319797 A1 each disclose a directional coupler including the first and second low-pass filters and two terminators, one of the two terminators being provided between the first capacitor of the first low-pass filter and the ground, and the other between the second capacitor of the second low-pass filter and the ground. The need for the two low-pass filters and the two terminators disadvantageously increases the size of the directional coupler.

OBJECT AND SUMMARY OF THE INVENTION

It is an object of the present invention to provide a directional coupler that is wideband capable without being increased in size, and is able to reduce signal reflection at the coupling port where the coupling port is connected with a signal source having an output impedance equal to the resistance of a terminator connected to the terminal port.

A directional coupler of the present invention includes an input port, an output port, a coupling port, a terminal port, a main line connecting the input port and the output port, and a subline connecting the coupling port and the terminal port. The subline includes a first coupling line section and a low-pass filter, the first coupling line section being configured to be electromagnetically coupled to the main line. The first coupling line section has a first end and a second end opposite to each other. The first end is connected to the terminal port. The low-pass filter includes a first path provided between the coupling port and the second end of the first coupling line section, and a second path connected to the first path. The first path has a third end and a fourth end opposite to each other, the third end being connected to the second end of the first coupling line section. The first path includes at least one inductor provided between the third end and the fourth end. The second path includes a first capacitor and a resistor, the first capacitor having two ends, one of the two ends being connected to the fourth end of the first path, the resistor connecting the other of the two ends of the first capacitor to a ground.

In the directional coupler of the present invention, the low-pass filter may further include a second capacitor connecting the third end of the first path to the ground.

In the directional coupler of the present invention, the subline may further include a second coupling line section configured to be electromagnetically coupled to the main line. The second coupling line section has a fifth end and a sixth end opposite to each other. The fifth end is connected to the coupling port. The sixth end is connected to the fourth end of the first path.

In the directional coupler of the present invention, the first path may include, as the at least one inductor, a first inductor and a second inductor connected in series. The low-pass filter may further include a third capacitor connecting a connection point between the first inductor and the second inductor to the ground.

In the directional coupler of the present invention, the resistor may have a resistance in the range of 20 to 90 Ω.

According to the directional coupler of the present invention, where a combination of the first coupling line section and a portion of the main line to be electromagnetically coupled to the first coupling line section is referred to as the first coupling section, a signal path passing through the first coupling section and the low-pass filter is formed between the input port and the coupling port. The attenuation of a signal as it passes through the low-pass filter varies according to the frequency of the signal. It is thus possible to suppress a change in the coupling of the directional coupler in response to a change in the frequency of the high frequency signal received at the input port. Further, in the directional coupler of the present invention, the low-pass filter includes the resistor connecting the aforementioned other end of the first capacitor to the ground. This makes it possible to reduce, with a simple configuration, signal reflection at the coupling port where the coupling port is connected with a signal source having an output impedance equal to the resistance of the terminator connected to the terminal port. Consequently, according to the present invention, it is possible to realize a directional coupler that is wideband capable without being increased in size and is able to reduce signal reflection at the coupling port where the coupling port is connected with a signal source having an output impedance equal to the resistance of a terminator connected to the terminal port.

Other and further objects, features and advantages of the invention will appear more fully from the following description.

DETAILED DESCRIPTION OF THE PREFERRED EMBODIMENTS

First Embodiment

Figure 1:
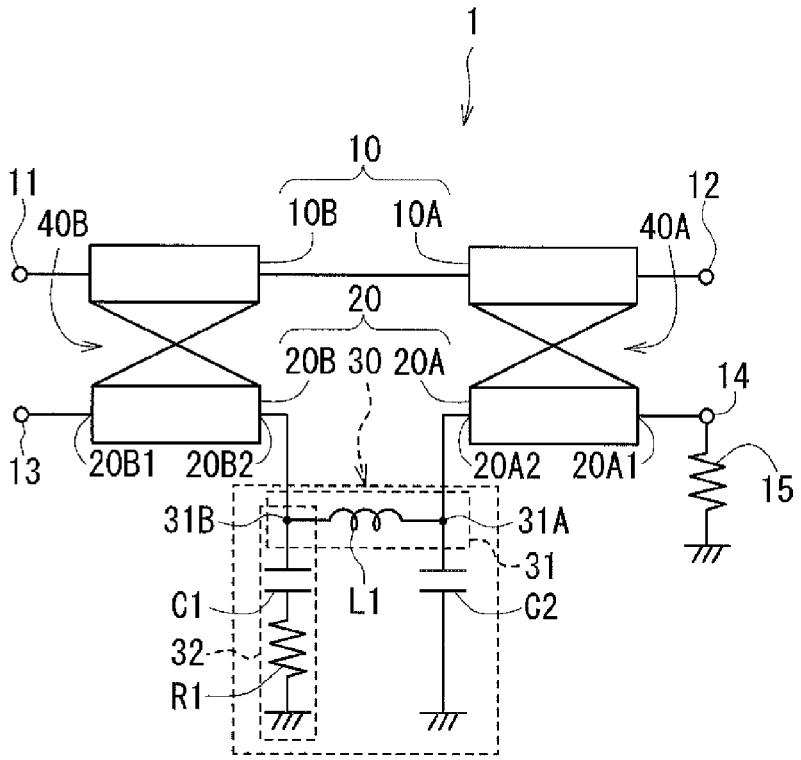
FIG. 1 is a circuit diagram showing the circuit configuration of a directional coupler according to a first embodiment of the invention.

Preferred embodiments of the present invention will now be described in detail with reference to the drawings. First, reference is made to FIG. 1 to describe the circuit configuration of a directional coupler according to a first embodiment of the invention. As shown in FIG. 1, the directional coupler 1 according to the first embodiment includes an input port 11, an output port 12, a coupling port 13, and a terminal port 14. The directional coupler 1 further includes a main line 10 connecting the input port 11 and the output port 12, and a subline 20 connecting the coupling port 13 and the terminal port 14. The terminal port 14 is grounded via a terminator 15. More specifically, one end of the terminator 15 is connected to the terminal port 14 and the other end thereof is connected to the ground. In the first embodiment, the terminator 15 has a resistance of 50Ω.

The subline 20 includes a first coupling line section 20A, a second coupling line section 20B, and a low-pass filter 30. The first and second coupling line sections 20A and 20B are each configured to be electromagnetically coupled to the main line 10. The first coupling line section 20A has a first end 20A1 and a second end 20A2 opposite to each other. The first end 20A1 is connected to the terminal port 14.

The low-pass filter 30 includes a first path 31 provided between the coupling port 13 and the second end 20A2 of the first coupling line section 20A, and a second path 32 connected to the first path 31. The first path 31 has a third end 31A and a fourth end 31B opposite to each other. The third end 31A is connected to the second end 20A2 of the first coupling line section 20A. The first path 31 includes at least one inductor provided between the third end 31A and the fourth end 31B. In the first embodiment, the first path 31 includes an inductor L1 as the at least one inductor. The second path 32 includes a first capacitor C1 and a resistor R1. The first capacitor C1 has two ends, one of the two ends being connected to the fourth end 31B of the first path 31. The resistor R1 connects the other of the two ends of the first capacitor C1 to the ground. The resistor R1 preferably has a resistance in the range of 20 to 90Ω. The low-pass filter 30 further includes a second capacitor C2 connecting the third end 31A of the first path 31 to the ground.

The second coupling line section 20B has a fifth end 20B1 and a sixth end 20B2 opposite to each other. The fifth end 20B1 is connected to the coupling port 13. The sixth end 20B2 is connected to the fourth end 31B of the first path 31.

The main line 10 includes a portion to be electromagnetically coupled to the first coupling line section 20A and a portion to be electromagnetically coupled to the second coupling line section 20B. These portions may be one and the same portion of the main line 10 or two different portions of the main line 10. The portion of the main line 10 to be electromagnetically coupled to the first coupling line section 20A will be referred to as the first portion 10A, and the portion of the main line 10 to be electromagnetically coupled to the second coupling line section 20B will be referred to as the second portion 10B. Further, a combination of the first portion 10A and the first coupling line section 20A will be referred to as the first coupling section 40A, and a combination of the second portion 10B and the second coupling line section 20B will be referred to as the second coupling section 40B. The strength of the coupling between the first portion 10A and the first coupling line section 20A may be the same as or different from the strength of the coupling between the second portion 10B and the second coupling line section 20B. The coupling between the first portion 10A and the first coupling line section 20A is preferably stronger than the coupling between the second portion 10B and the second coupling line section 20B.

The low-pass filter 30 is designed so that in the service frequency band of the directional coupler 1, the attenuation of a signal as it passes through the low-pass filter 30 varies according to the frequency of the signal. More specifically, the low-pass filter 30 is designed so that in at least some frequency range within the service frequency band of the directional coupler 1, the attenuation of a signal as it passes through the low-pass filter 30 increases with increasing frequency of the signal. The cut-off frequency of the low-pass filter 30 may be present within or outside the service frequency band of the directional coupler 1. The service frequency band of the directional coupler 1 is 0.7 to 2.7 GHz, for example.

Further, the low-pass filter 30 is designed so that in the service frequency band of the directional coupler 1, the impedance as seen from the second coupling line section 20B is 50Ω or close thereto. Consequently, where the terminal port 14 is grounded via the terminator 15 having a resistance of 50Ω and the coupling port 13 is connected with a signal source having an output impedance equal to the resistance (50Ω) of the terminator 15, the reflection coefficient as seen in the direction from the coupling port 13 to the terminal port 14 has an absolute value of zero or near zero in the service frequency band of the directional coupler 1, which results in reduced signal reflection at the coupling port 13.

The function and effects of the directional coupler 1 according to the first embodiment will now be described. A high frequency signal is received at the input port 11 and output from the output port 12. The coupling port 13 outputs a coupling signal having a power that depends on the power of the high frequency signal received at the input port 11.

A first signal path passing through the first coupling section 40A and the low-pass filter 30 and a second signal path passing through the second coupling section 40B are formed between the input port 11 and the coupling port 13. Once the input port 11 has received a high frequency signal, the coupling port 13 outputs the coupling signal which is a combined signal resulting from a combination of a signal having passed through the first signal path and a signal having passed through the second signal path. A phase difference occurs between the signal having passed through the first signal path and the signal having passed through the second signal path. The coupling of the directional coupler 1 depends on the coupling of each of the first coupling section 40A and the second coupling section 40B alone, the phase difference between the signal having passed through the first signal path and the signal having passed through the second signal path, and the attenuation of a signal as it passes through the low-pass filter 30.

In the first embodiment, the first coupling section 40A, the second coupling section 40B and the low-pass filter 30 have the function of suppressing a change in the coupling of the directional coupler 1 in response to a change in the frequency of the high frequency signal. This will be described in detail below. The coupling of each of the first coupling section 40A and the second coupling section 40B alone increases with increasing frequency of the high frequency signal in the service frequency band of the directional coupler 1. This acts to cause a signal passing through the first signal path and a signal passing through the second signal path to increase in power with increasing frequency of the high frequency signal.

On the other hand, the attenuation of a signal as it passes through the low-pass filter 30 varies according to the frequency of the signal. More specifically, in at least some frequency region within the service frequency band of the directional coupler 1, the attenuation of a signal as it passes through the low-pass filter 30 increases with increasing frequency of the signal. The low-pass filter 30 thus operates to cause the power of a signal passing through the first signal path to decrease with increasing frequency of the high frequency signal in at least some frequency range within the service frequency band of the directional coupler 1. At least this operation of the low-pass filter 30 allows for suppression of changes in the power of the coupling signal or changes in the coupling of the directional coupler 1 with increases in the frequency of the high frequency signal.

The low-pass filter 30 may also be designed so that in the service frequency band of the directional coupler 1, the phase difference between a signal having passed through the first signal path and a signal having passed through the second signal path increases within the range of 0° to 180° as the frequency of the high frequency signal increases. Such design also allows for suppression of changes in the power of the coupling signal or changes in the coupling of the directional coupler 1 with increases in the frequency of the high frequency signal.

In the first embodiment, the low-pass filter 30 includes the resistor R1 connecting the aforementioned other end of the first capacitor C1 to the ground. This makes it possible that, in the service frequency band of the directional coupler 1, signal reflection at the coupling port 13 where the coupling port 13 is connected with a signal source having an output impedance equal to the resistance (50Ω) of the terminator 15 connected to the terminal port 14 can be reduced with a simple configuration obtained by simply adding the resistor R1 to the low-pass filter having no resistor R1.

Figure 2:
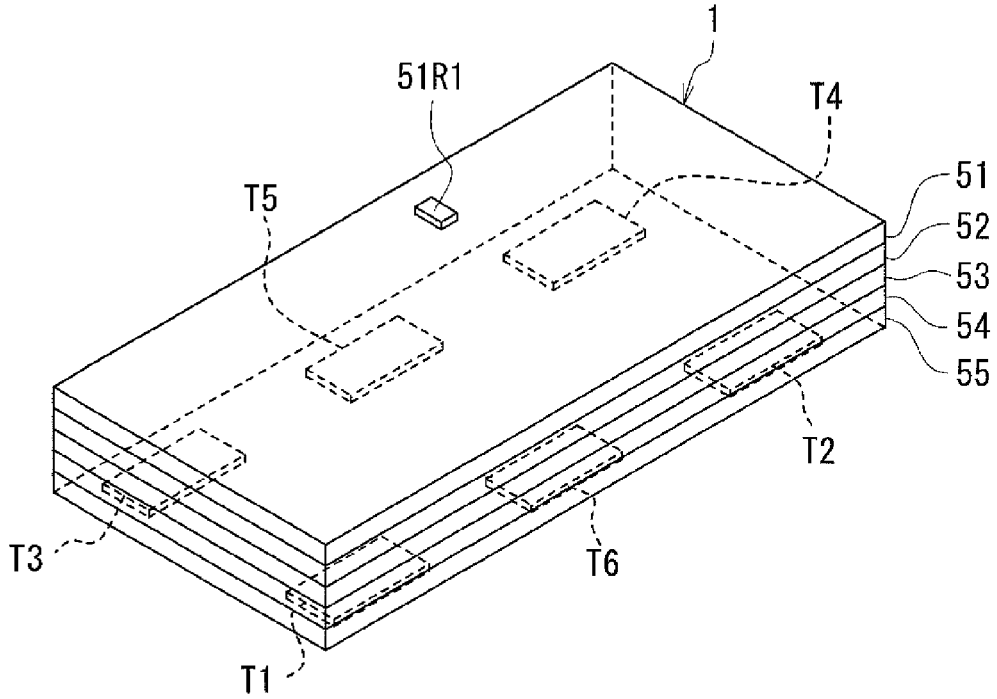
FIG. 2 is a perspective view showing the appearance of the directional coupler according to the first embodiment of the invention.

An example of the structure of the directional coupler 1 will now be described with reference to FIG. 2 to FIG. 6B. FIG. 2 is a perspective view showing the appearance of the directional coupler 1. The directional coupler 1 shown in FIG. 2 includes a stack of five dielectric layers. The five dielectric layers will be referred to as the first dielectric layer 51, the second dielectric layer 52, the third dielectric layer 53, the fourth dielectric layer 54, and the fifth dielectric layer 55, from top to bottom. A resistive film 51R1 constituting the resistor R1 is provided on the top surface of the first dielectric layer 51. An input terminal T1, an output terminal T2, a coupling terminal T3, an end terminal T4, a ground terminal T5, and an unused terminal T6 are provided on the bottom surface of the fifth dielectric layer 55. The input terminal T1, the output terminal T2, the coupling terminal T3 and the end terminal T4 correspond to the input port 11, the output port 12, the coupling port 13 and the terminal port 14 shown in FIG. 1, respectively. The ground terminal T5 is connected to the ground.

Figure 3A:
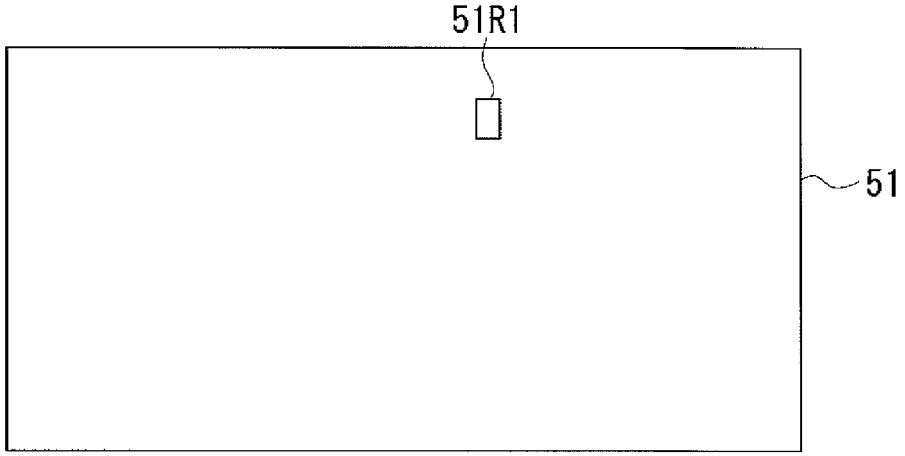
FIG. 3A to FIG. 3C are explanatory diagrams for explaining the structure of the directional coupler shown in FIG. 2.

The structure of the directional coupler 1 shown in FIG. 2 will be described in more detail with reference to FIG. 3A to FIG. 6B. FIG. 3A shows a component on the top surface of the first dielectric layer 51. As mentioned above, the resistive film 51R1 is provided on the top surface of the first dielectric layer 51. The resistive film 51R1 is formed of a thin film of metal such as NiCr.

Figure 3B:
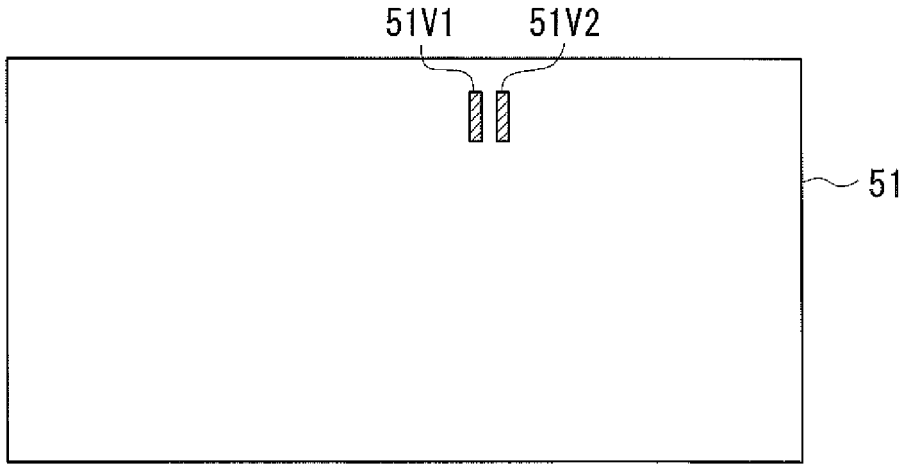

FIG. 3B shows the first dielectric layer 51 and components penetrating the same. Conductor sections 51V1 and 51V2 are formed in the first dielectric layer 51 to penetrate the first dielectric layer 51. The conductor sections 51V1 and 51V2 are connected to the resistive film 51R1 shown in FIG. 3A.

Figure 3C:
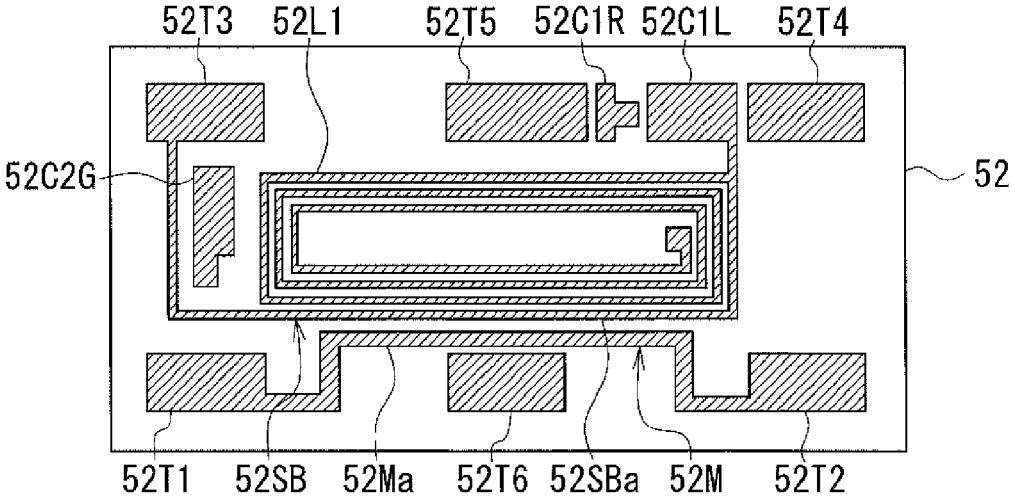

FIG. 3C shows components on the top surface of the second dielectric layer 52. Conductor layers 52T1, 52T2, 52T3, 52T4, 52T5 and 52T6 are provided on the top surface of the second dielectric layer 52. As viewed from above the second dielectric layer 52, the conductor layers 52T1, 52T2, 52T3, 52T4, 52T5 and 52T6 are positioned to overlap the terminals T1, T2, T3, T4, T5 and T6, respectively. The conductor layer 52T5 is connected to the conductor section 51V1 shown in FIG. 3B.

A conductor layer 52M is also provided on the top surface of the second dielectric layer 52. The conductor layer 52M constitutes the main line 10. The conductor layer 52M has a first end connected to the conductor layer 52T1 and a second end connected to the conductor layer 52T2. The conductor layer 52M includes a portion 52Ma extending linearly. The portion 52Ma constitutes the first portion 10A and the second portion 10B.

Conductor layers 52C1R, 52C1L and 52C2G are also provided on the top surface of the second dielectric layer 52. The conductor layer 52C1R is connected to the conductor section 51V2 shown in FIG. 3B.

Conductor layers 52SB and 52L1 are also provided on the top surface of the second dielectric layer 52. The conductor layer 52SB has a first end connected to the conductor layer 52T3 and a second end connected to the conductor layer 52C1L. The conductor layer 52SB includes a portion 52SBa extending in parallel with the portion 52Ma of the conductor layer 52M. The portion 52SBa constitutes the second coupling line section 20B. The conductor layer 52L1 is spiral-shaped and has a first end and a second end. The first end of the conductor layer 52L1 is connected to the conductor layer 52SB at a location near the conductor layer 52C1L. The conductor layer 52L1 constitutes a portion of the inductor L1.

Figure 4A:
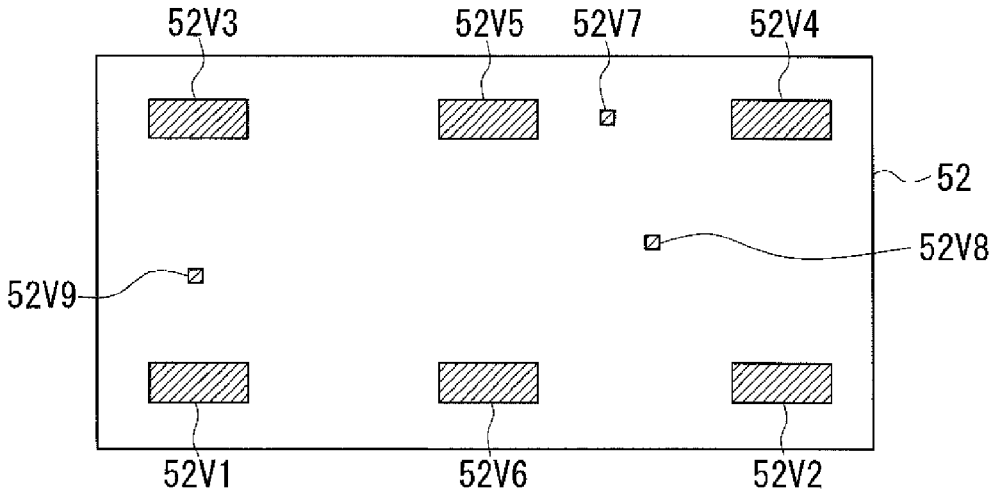
FIG. 4A to FIG. 4C are explanatory diagrams for explaining the structure of the directional coupler shown in FIG. 2.

FIG. 4A shows the second dielectric layer 52 and components penetrating the same. Conductor sections 52V1, 52V2, 52V3, 52V4, 52V5, 52V6, 52V7, 52V8 and 52V9 are formed in the second dielectric layer 52 to penetrate the second dielectric layer 52. The conductor sections 52V1, 52V2, 52V3, 52V4, 52V5 and 52V6 are connected to the conductor layers 52T1, 52T2, 52T3, 52T4, 52T5 and 52T6 shown in FIG. 3C, respectively. The conductor section 52V7 is connected to the conductor layer 52C1R shown in FIG. 3C. The conductor section 52V8 is connected to a portion of the conductor layer 52L1 shown in FIG. 3C near the second end thereof. The conductor section 52V9 is connected to the conductor layer 52C2G shown in FIG. 3C.

Figure 4B:
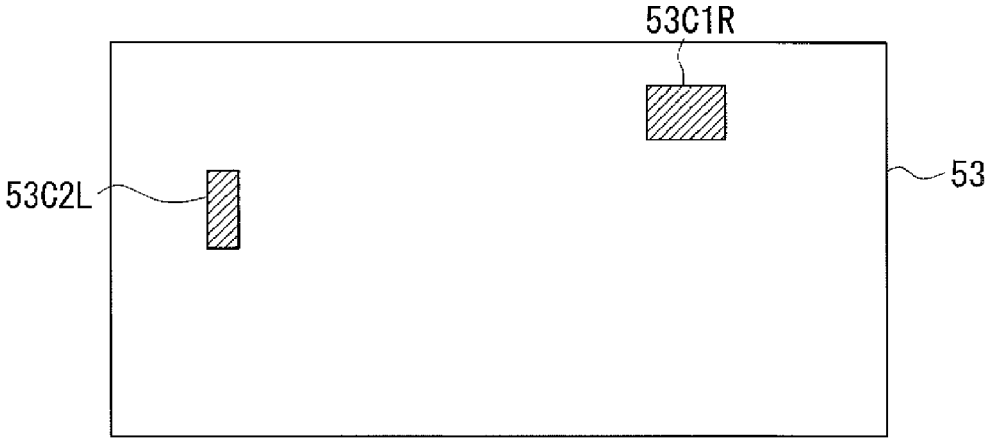

FIG. 4B shows components on the top surface of the third dielectric layer 53. Conductor layers 53C1R and 53C2L are provided on the top surface of the third dielectric layer 53. The conductor layer 53C1R is opposed to the conductor layer 52C1L shown in FIG. 3C with the second dielectric layer 52 interposed therebetween. The conductor layers 52C1L and 53C1R and the second dielectric layer 52 interposed therebetween constitute the first capacitor C1. The conductor layer 53C2L is opposed to the conductor layer 52C2G shown in FIG. 3C with the second dielectric layer 52 interposed therebetween. The conductor layers 52C2G and 53C2L and the second dielectric layer 52 interposed therebetween constitute the second capacitor C2.

Figure 4C:
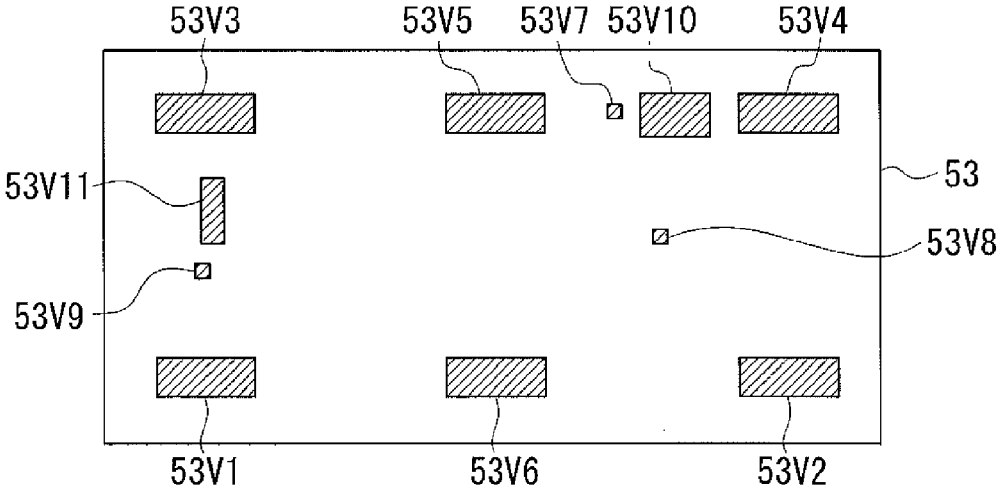

FIG. 4C shows the third dielectric layer 53 and components penetrating the same. Conductor sections 53V1, 53V2, 53V3, 53V4, 53V5, 53V6, 53V7, 53V8, 53V9, 53V10 and 53V11 are formed in the third dielectric layer 53 to penetrate the third dielectric layer 53. The conductor sections 53V1, 53V2, 53V3, 53V4, 53V5, 53V6, 53V7, 53V8 and 53V9 are connected to the conductor sections 52V1, 52V2, 52V3, 52V4, 52V5, 52V6, 52V7, 52V8 and 52V9 shown in FIG. 4A, respectively. The conductor section 53V10 is connected to the conductor layer 53C1R shown in FIG. 4B. The conductor section 53V11 is connected to the conductor layer 53C2L shown in FIG. 4B.

Figure 5A:
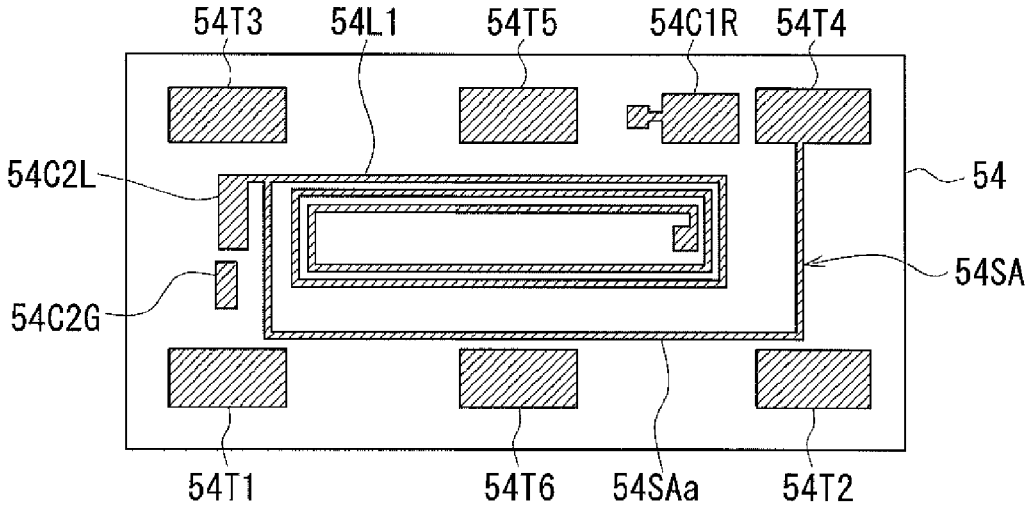
FIG. 5A to FIG. 5C are explanatory diagrams for explaining the structure of the directional coupler shown in FIG. 2.

FIG. 5A shows components on the top surface of the fourth dielectric layer 54. Conductor layers 54T1, 54T2, 54T3, 54T4, 54T5 and 54T6 are provided on the top surface of the fourth dielectric layer 54. The conductor layers 54T1, 54T2, 54T3, 54T4, 54T5 and 54T6 are connected to the conductor sections 53V1, 53V2, 53V3, 53V4, 53V5 and 53V6 shown in FIG. 4C, respectively.

Conductor layers 54C1R, 54C2L and 54C2G are also provided on the top surface of the fourth dielectric layer 54. The conductor layer 54C1R is connected to the conductor sections 53V7 and 53V10 shown in FIG. 4C. The conductor layer 54C2L is connected to the conductor section 53V11 shown in FIG. 4C. The conductor layer 54C2G is connected to the conductor section 53V9 shown in FIG. 4C.

Conductor layers 54SA and 54L1 are also provided on the top surface of the fourth dielectric layer 54. The conductor layer 54SA has a first end connected to the conductor layer 54T4 and a second end connected to the conductor layer 54C2L. The conductor layer 54SA includes a portion 54SAa opposed to the portion 52Ma of the conductor layer 52M shown in FIG. 3C with the second and third dielectric layers 52 and 53 interposed therebetween. The portion 54SAa constitutes the first coupling line section 20A. The conductor layer 54L1 is spiral-shaped and has a first end and a second end. The first end of the conductor layer 54L1 is connected to the second end of the conductor layer 54SA. The conductor section 53V8 shown in FIG. 4C is connected to a portion of the conductor layer 54L1 near the second end thereof. The conductor layer 54L1 constitutes another portion of the inductor L1.

Figure 5B:
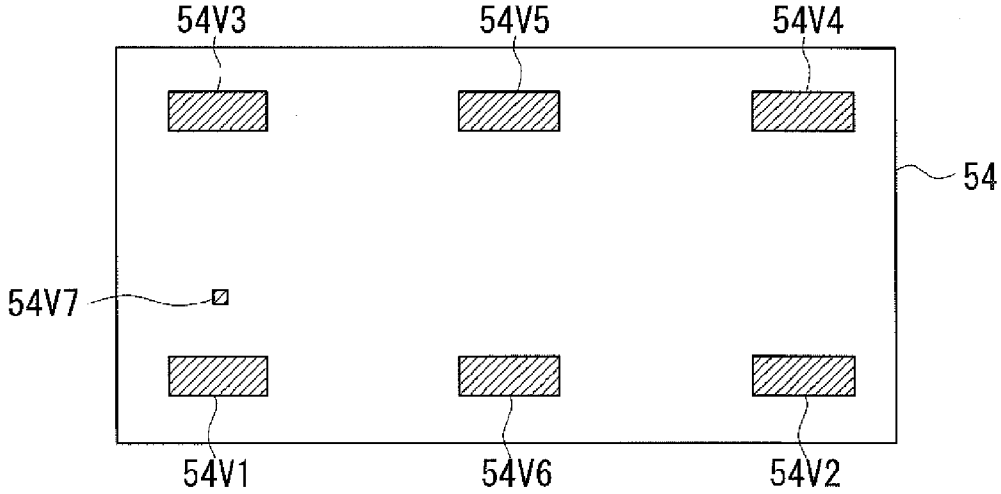

FIG. 5B shows the fourth dielectric layer 54 and components penetrating the same. Conductor sections 54V1, 54V2, 54V3, 54V4, 54V5, 54V6 and 54V7 are formed in the fourth dielectric layer 54 to penetrate the fourth dielectric layer 54. The conductor sections 54V1, 54V2, 54V3, 54V4, 54V5, 54V6 and 54V7 are connected to the conductor layers 54T1, 54T2, 54T3, 54T4, 54T5, 54T6 and 54C2G shown in FIG. 5A, respectively.

Figure 5C:
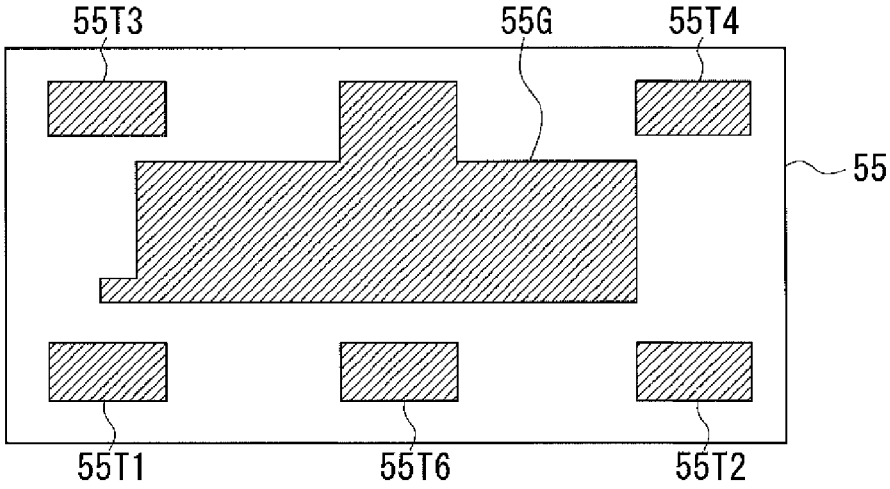

FIG. 5C shows components on the top surface of the fifth dielectric layer 55. A ground conductor layer 55G and conductor layers 55T1, 55T2, 55T3, 55T4 and 55T6 are provided on the top surface of the fifth dielectric layer 55. The ground conductor layer 55G is connected to the conductor sections 54V5 and 54V7 shown in FIG. 5B. The conductor layers 55T1, 55T2, 55T3, 55T4 and 55T6 are connected to the conductor sections 54V1, 54V2, 54V3, 54V4 and 54V6 shown in FIG. 5B, respectively.

Figure 6A:
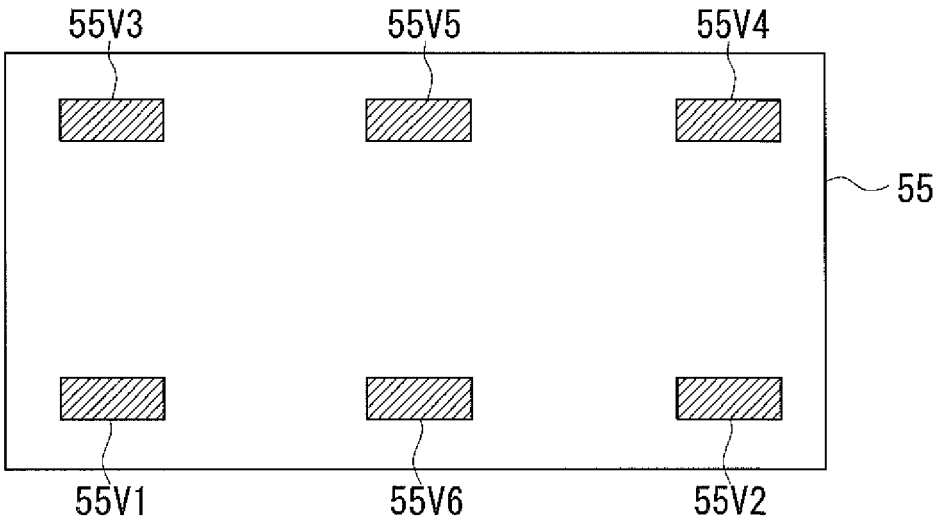
FIG. 6A and FIG. 6B are explanatory diagrams for explaining the structure of the directional coupler shown in FIG. 2.

FIG. 6A shows the fifth dielectric layer 55 and components penetrating the same. Conductor sections 55V1, 55V2, 55V3, 55V4, 55V5 and 55V6 are formed in the fifth dielectric layer 55 to penetrate the fifth dielectric layer 55. The conductor sections 55V1, 55V2, 55V3, 55V4, 55V5 and 55V6 are connected to the conductor layers 55T1, 55T2, 55T3, 55T4, 55G and 55T6 shown in FIG. 5C, respectively.

Figure 6B:
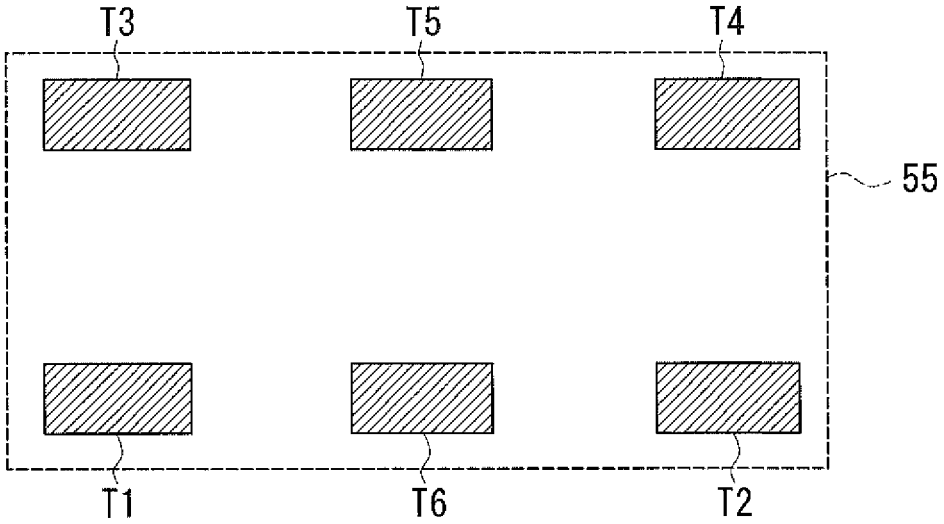

FIG. 6B shows components beneath the bottom surface of the fifth dielectric layer 55. The terminals T1, T2, T3, T4, T5 and T6 (see FIG. 2) are arranged beneath the bottom surface of the fifth dielectric layer 55. The terminals T1, T2, T3, T4, T5 and T6 are connected to the conductor sections 55V1, 55V2, 55V3, 55V4, 55V5 and 55V6 shown in FIG. 6A, respectively.

Figure 7:
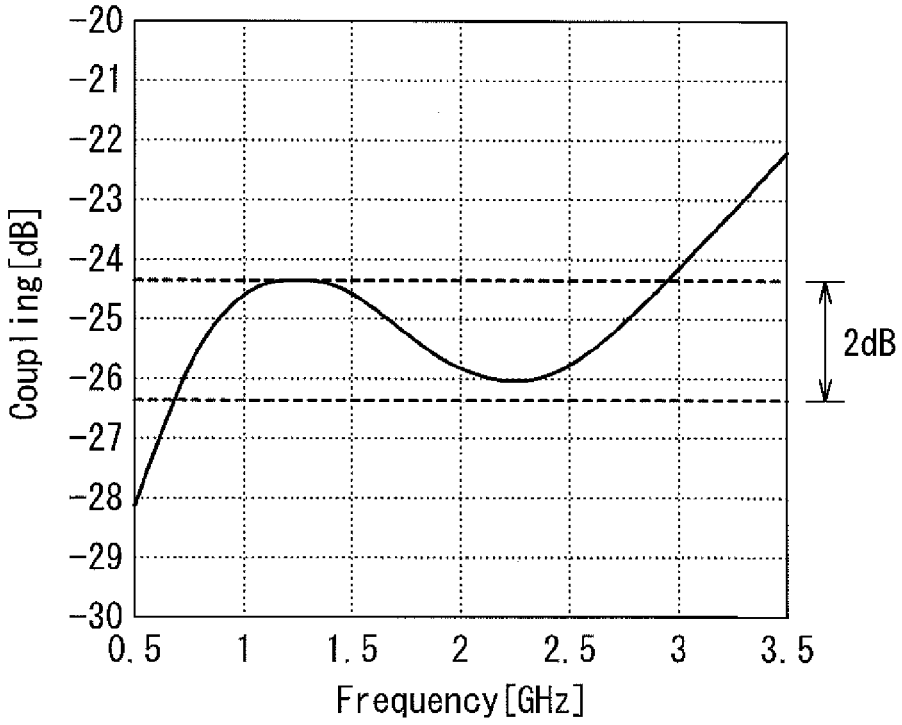
FIG. 7 is a characteristic diagram showing the frequency response of the coupling of the directional coupler according to the first embodiment of the invention.
Figure 8:
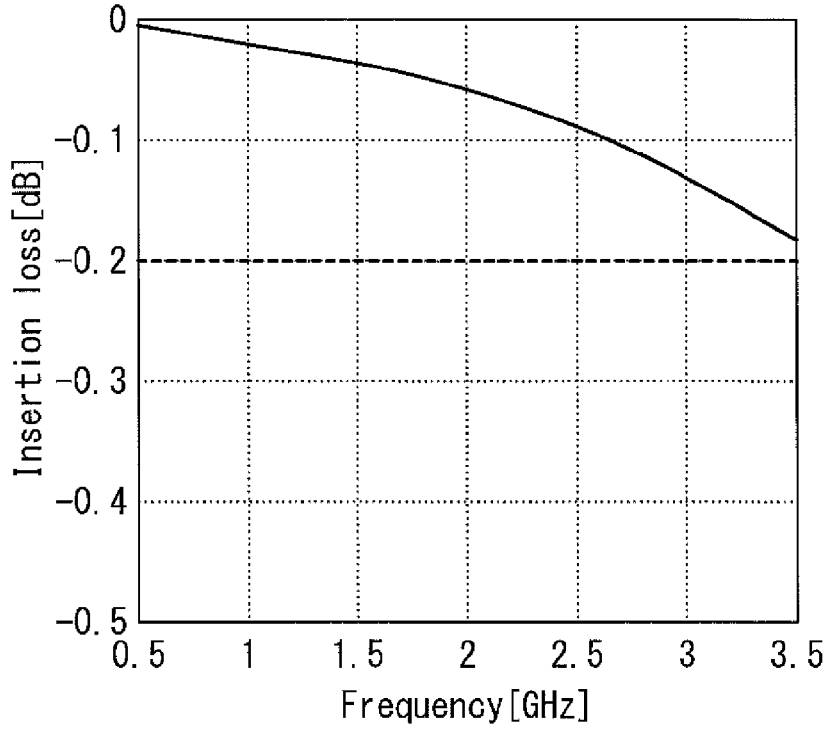
FIG. 8 is a characteristic diagram showing the frequency response of the insertion loss of the directional coupler according to the first embodiment of the invention.
Figure 9:
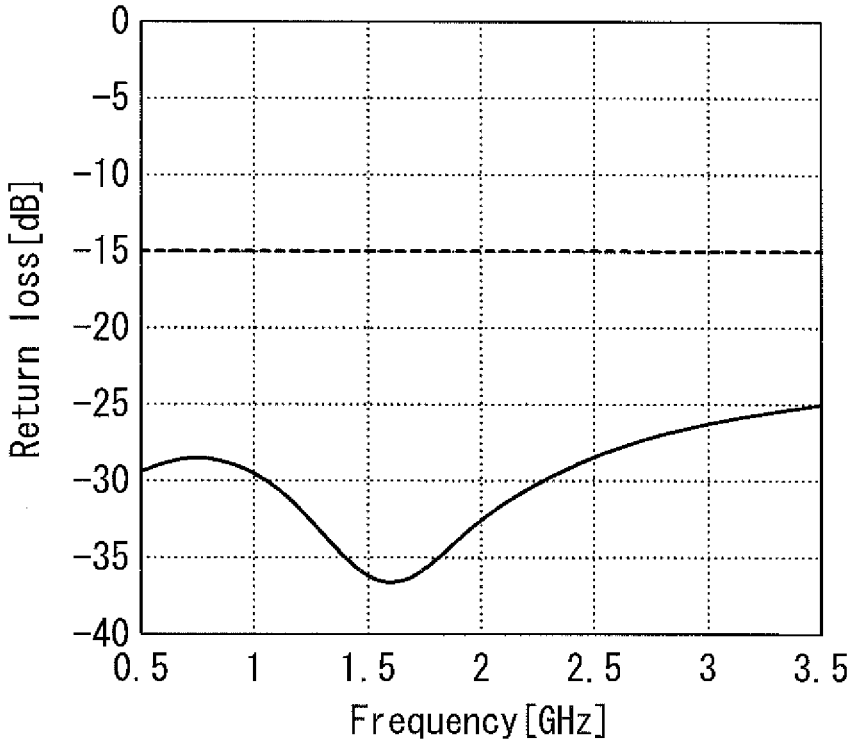
FIG. 9 is a characteristic diagram showing the frequency response of the return loss at the coupling port of the directional coupler according to the first embodiment of the invention.

An example of characteristics of the directional coupler 1 according to the first embodiment will now be described with reference to FIG. 7 to FIG. 9. In this example, the resistance of the resistor R1 is set to 43Ω. FIG. 7 is a characteristic diagram showing the frequency response of the coupling of the directional coupler 1. FIG. 8 is a characteristic diagram showing the frequency response of the insertion loss of the directional coupler 1. FIG. 9 is a characteristic diagram showing the frequency response of the return loss at the coupling port 13 of the directional coupler 1. In each of FIG. 7 to FIG. 9 the horizontal axis represents frequency. The vertical axes in FIG. 7, FIG. 8, and FIG. 9 represent coupling, insertion loss, and return loss at the coupling port 13, respectively.

According to the frequency response of the coupling shown in FIG. 7, the difference between the minimum value and the maximum value of the coupling in the service frequency band of the directional coupler 1 (0.7 to 2.7 GHz) is approximately 2 dB, which indicates that variations in coupling are sufficiently suppressed.

The frequency response of the insertion loss shown in FIG. 8 indicates that, where the insertion loss is denoted as −x (dB), the value of x in the 0.7- to 2.7-GHz band is 0.2 or below, which is sufficiently small.

The frequency response of the return loss at the coupling port 13 shown in FIG. 9 indicates that, where the return loss is denoted as −r (dB), the value of r in the 0.7- to 2.7-GHz band is 15 or above, which is sufficiently large.

Figure 10:
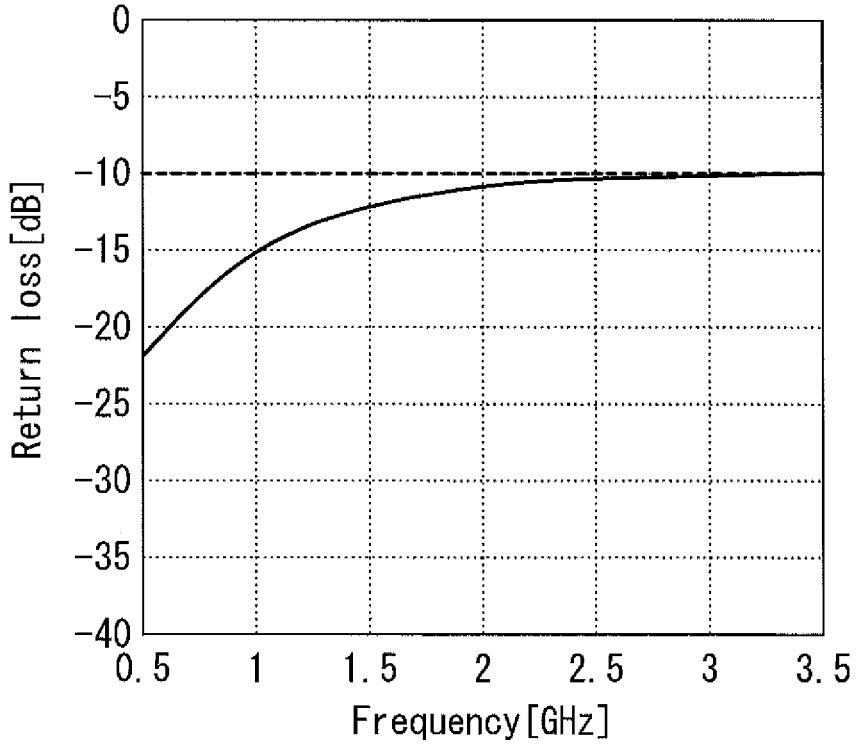
FIG. 10 is a characteristic diagram showing the frequency response of the return loss at the coupling port of the directional coupler according to the first embodiment where the resistance of the resistor is set to a maximum value.
Figure 11:
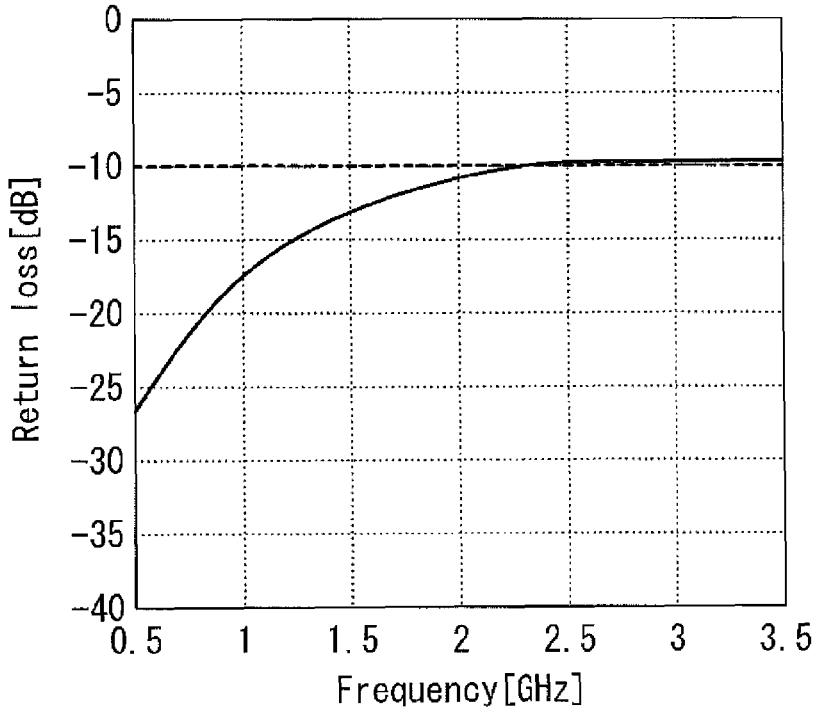
FIG. 11 is a characteristic diagram showing the frequency response of the return loss at the coupling port of the directional coupler according to the first embodiment where the resistance of the resistor is set to a minimum value.

A preferred range of the resistance of the resistor R1 will now be described with reference to FIG. 10 and FIG. 11. FIG. 10 shows the frequency response of the return loss at the coupling port 13 where the resistance of the resistor R1 is set to 90Ω. FIG. 11 shows the frequency response of the return loss at the coupling port 13 where the resistance of the resistor R1 is set to 20Ω. The frequency responses shown in these figures indicate that the minimum value of r in the 0.7- to 2.7-GHz band is approximately 10. When the resistance of the resistor R1 falls within the range of 20 to 90Ω, the minimum value of r in the 0.7- to 2.7-GHz band is approximately 10 or above. When the resistance of the resistor R1 falls outside the range of 20 to 90Ω, the minimum value of r in the 0.7- to 2.7-GHz band is smaller than 10, which is insufficient in magnitude. It is thus preferred that the resistance of the resistor R1 fall within the range of 20 to 90Ω.

As has been described, the first embodiment provides the directional coupler 1 which is wideband capable without being increased in size, and is able to reduce signal reflection at the coupling port 13 where the coupling port 13 is connected with a signal source having an output impedance equal to the resistance of the terminator 15 connected to the terminal port 14.

Second Embodiment

Figure 12:
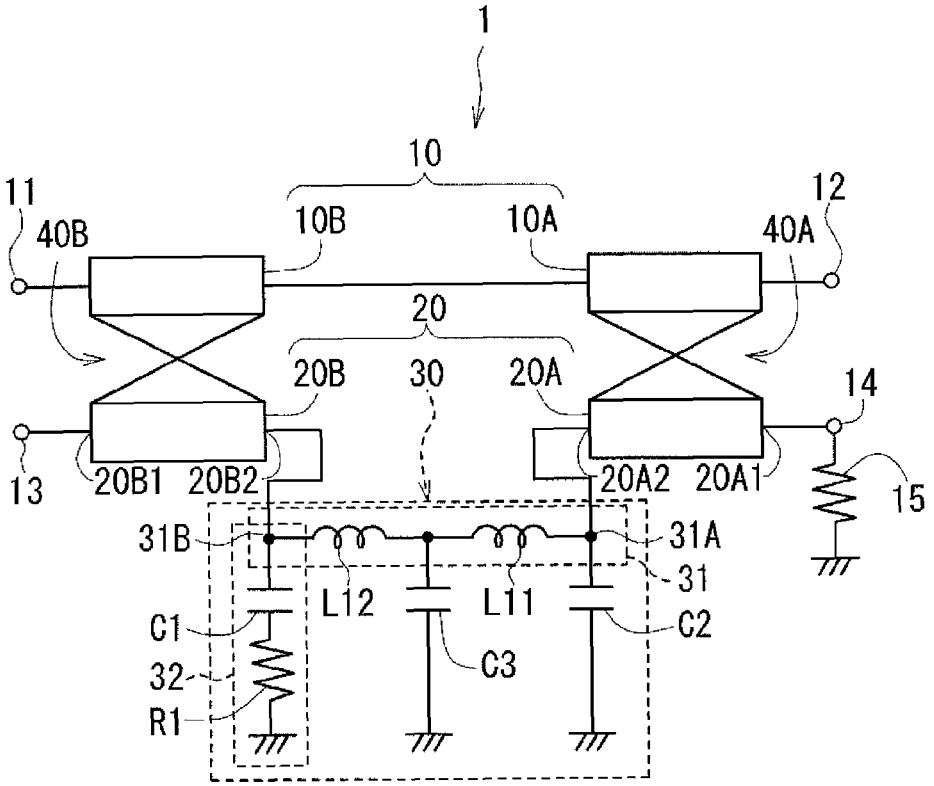
FIG. 12 is a circuit diagram showing the circuit configuration of a directional coupler according to a second embodiment of the invention.

A directional coupler 1 according to a second embodiment of the invention will now be described with reference to FIG. 12. FIG. 12 is a circuit diagram showing the circuit configuration of the directional coupler 1 according to the second embodiment. In the directional coupler 1 according to the second embodiment, the low-pass filter 30 is configured differently than the first embodiment.

In the second embodiment, the low-pass filter 30 includes a first path 31, a second path 32 and a second capacitor C2 as in the first embodiment. The first path 31 has a third end 31A and a fourth end 31B opposite to each other. The third end 31A is connected to the second end 20A2 of the first coupling line section 20A. The first path 31 includes at least one inductor provided between the third end 31A and the fourth end 31B. In the second embodiment the first path 31 includes, as the at least one inductor, a first inductor L11 and a second inductor L12 connected in series. The second path 32 of the second embodiment has the same configuration as that of the first embodiment.

The low-pass filter 30 of the second embodiment further includes a third capacitor C3 connecting the connection point between the first inductor L11 and the second inductor L12 to the ground.

Figure 13:
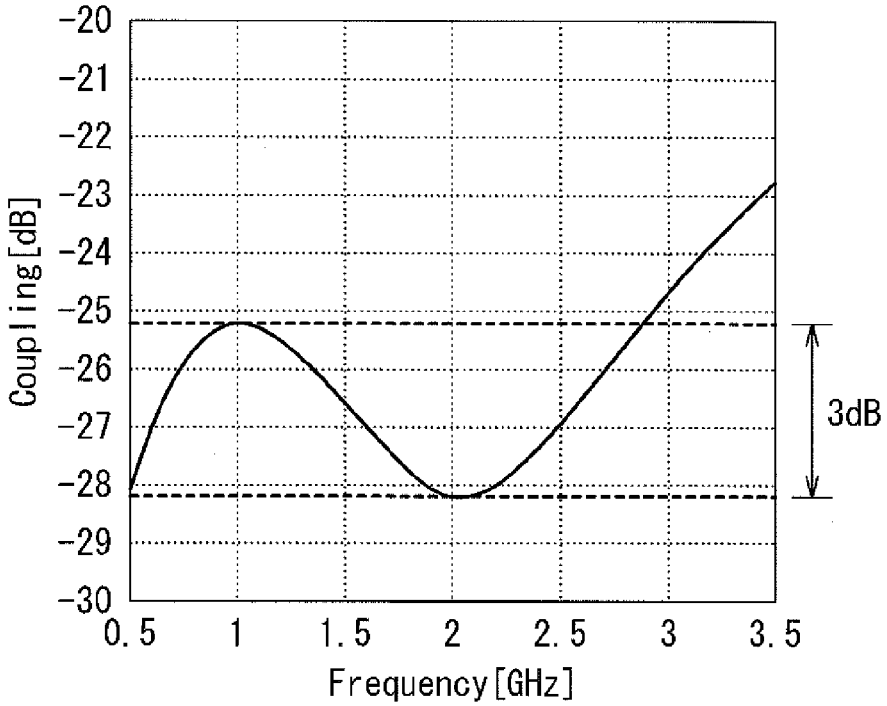
FIG. 13 is a characteristic diagram showing the frequency response of the coupling of the directional coupler according to the second embodiment of the invention.
Figure 14:
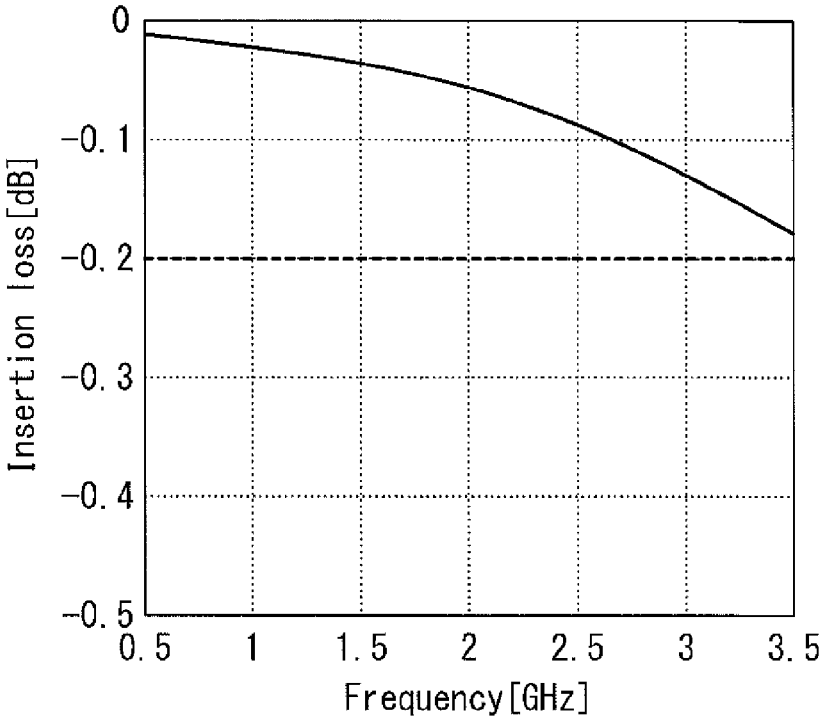
FIG. 14 is a characteristic diagram showing the frequency response of the insertion loss of the directional coupler according to the second embodiment of the invention.
Figure 15:
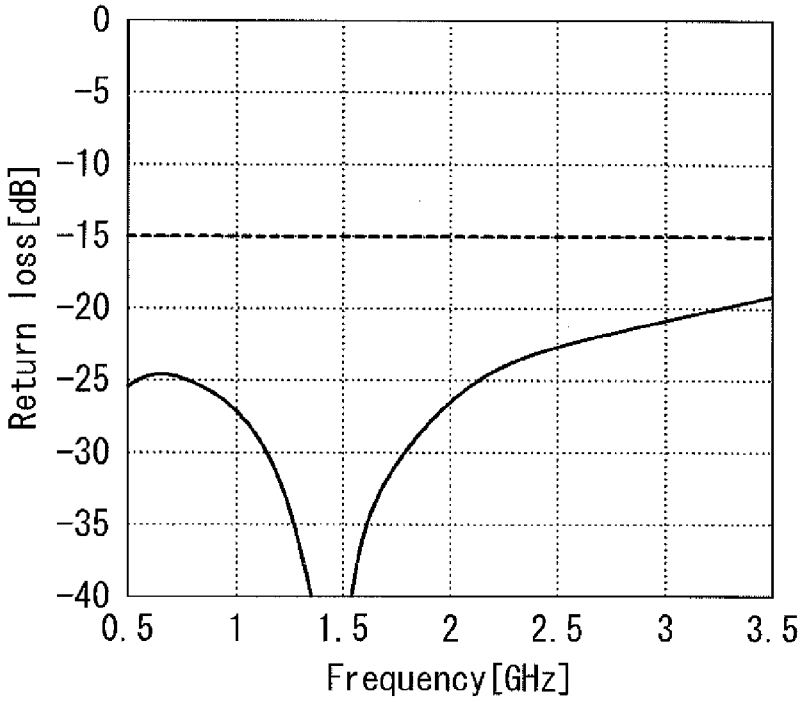
FIG. 15 is a characteristic diagram showing the frequency response of the return loss at the coupling port of the directional coupler according to the second embodiment of the invention.

An example of characteristics of the directional coupler 1 according to the second embodiment will now be described with reference to FIG. 13 to FIG. 15. FIG. 13 is a characteristic diagram showing the frequency response of the coupling of the directional coupler 1. FIG. 14 is a characteristic diagram showing the frequency response of the insertion loss of the directional coupler 1. FIG. 15 is a characteristic diagram showing the frequency response of the return loss at the coupling port 13 of the directional coupler 1. In each of FIG. 13 to FIG. 15 the horizontal axis represents frequency. The vertical axes in FIG. 13, FIG. 14, and FIG. 15 represent coupling, insertion loss, and return loss at the coupling port 13, respectively.

According to the frequency response of the coupling shown in FIG. 13, the difference between the minimum value and the maximum value of the coupling in the service frequency band of the directional coupler 1 (0.7 to 2.7 GHz) is approximately 3 dB, which indicates that variations in coupling are sufficiently suppressed. The configuration of the low-pass filter 30 of the second embodiment allows for easy adjustment of the depth of the attenuation pole to be formed at approximately 2 GHz in the frequency response of the coupling shown in FIG. 13.

The frequency response of the insertion loss shown in FIG. 14 indicates that, where the insertion loss is denoted as −x (dB), the value of x in the 0.7- to 2.7-GHz band is 0.2 or below, which is sufficiently small.

The frequency response of the return loss at the coupling port 13 shown in FIG. 15 indicates that, where the return loss is denoted as −r (dB), the value of r in the 0.7- to 2.7-GHz band is 15 or above, which is sufficiently large.

The remainder of configuration, function and effects of the second embodiment are similar to those of the first embodiment.

Third Embodiment

Figure 16:
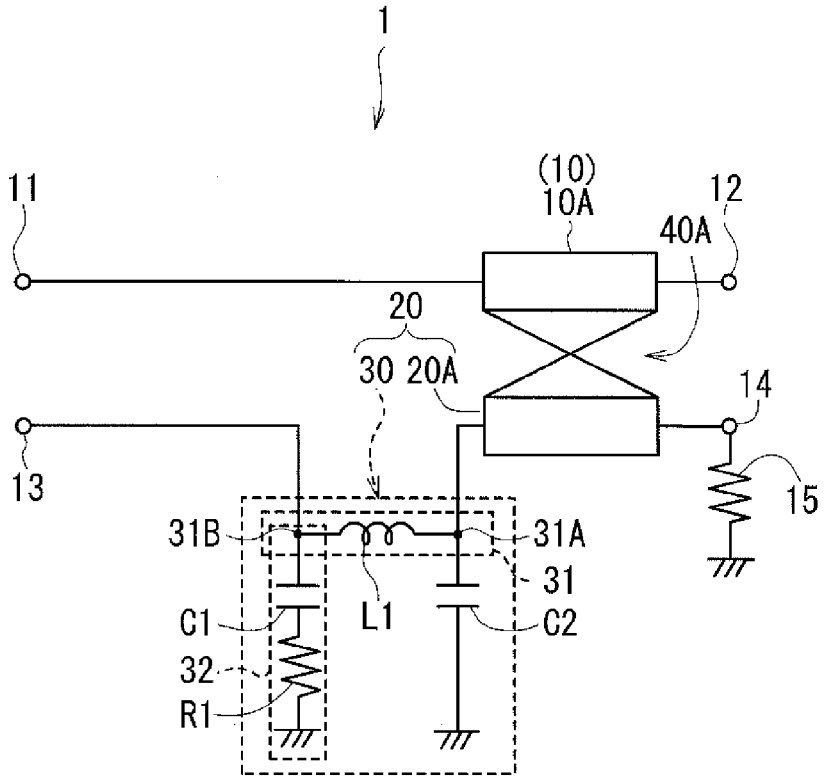
FIG. 16 is a circuit diagram showing the circuit configuration of a directional coupler according to a third embodiment of the invention.

A directional coupler 1 according to a third embodiment of the invention will now be described with reference to FIG. 16. FIG. 16 is a circuit diagram showing the circuit configuration of the directional coupler 1 according to the third embodiment. In the directional coupler 1 according to the third embodiment, the subline 20 includes the first coupling line section 20A and the low-pass filter 30 but does not include the second coupling line section 20B. The main line 10 includes the first portion 10A but does not include the second portion 10B. Further, the directional coupler 1 according to the third embodiment includes the first coupling section 40A but does not include the second coupling section 40B.

The low-pass filter 30 of the third embodiment may have the same configuration as that of the first or second embodiment. FIG. 16 illustrates the case where the low-pass filter 30 has the same configuration as that of the first embodiment. In the third embodiment, the fourth end 31B of the first path 31 is directly connected to the coupling port 13.

The function and effects of the directional coupler 1 according to the third embodiment will now be described. In the third embodiment, only the first signal path passing through the first coupling section 40A and the low-pass filter 30 is formed between the input port 11 and the coupling port 13. Once the input port 11 has received a high frequency signal, the coupling port 13 outputs a signal having passed through the first signal path. The coupling of the directional coupler 1 depends on the coupling of the first coupling section 40A alone and the attenuation of a signal as it passes through the low-pass filter 30.

In the third embodiment, the coupling of the first coupling section 40A alone increases with increasing frequency of the high frequency signal in the service frequency band of the directional coupler 1. This acts to cause the power of a signal passing through the first signal path to increase with increasing frequency of the high frequency signal.

On the other hand, the attenuation of a signal as it passes through the low-pass filter 30 varies according to the frequency of the signal. More specifically, in at least some frequency region within the service frequency band of the directional coupler 1, the attenuation of a signal as it passes through the low-pass filter 30 increases with increasing frequency of the signal. The low-pass filter 30 thus operates to cause the power of a signal passing through the first signal path to decrease with increasing frequency of the high frequency signal in at least some frequency range within the service frequency band of the directional coupler 1. According to the third embodiment, at least this operation of the low-pass filter 30 allows for suppression of changes in the coupling of the directional coupler 1 with increases in the frequency of the high frequency signal.

Figure 17:
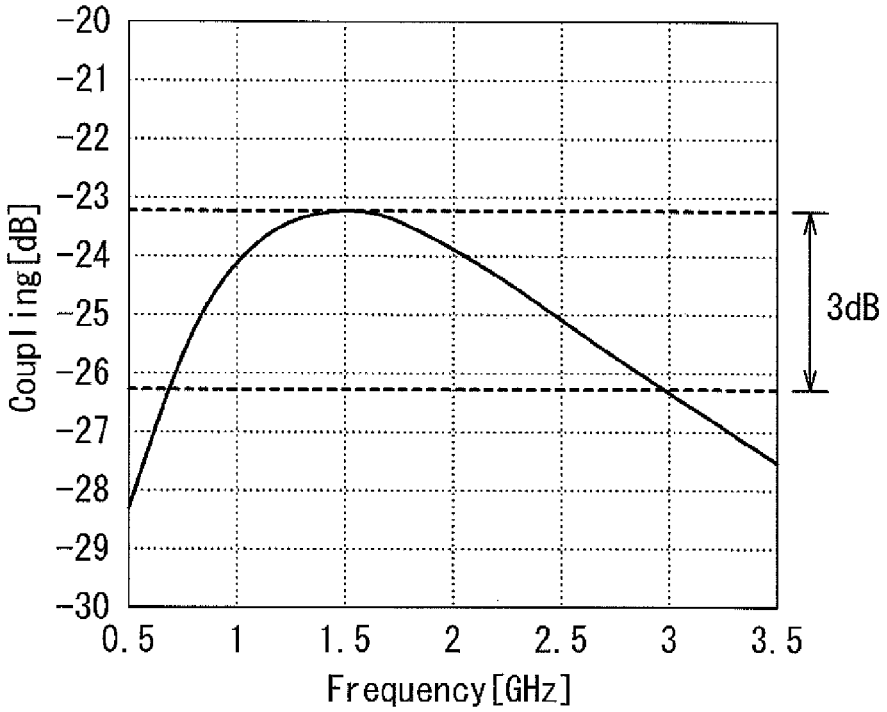
FIG. 17 is a characteristic diagram showing the frequency response of the coupling of the directional coupler according to the third embodiment of the invention.
Figure 18:
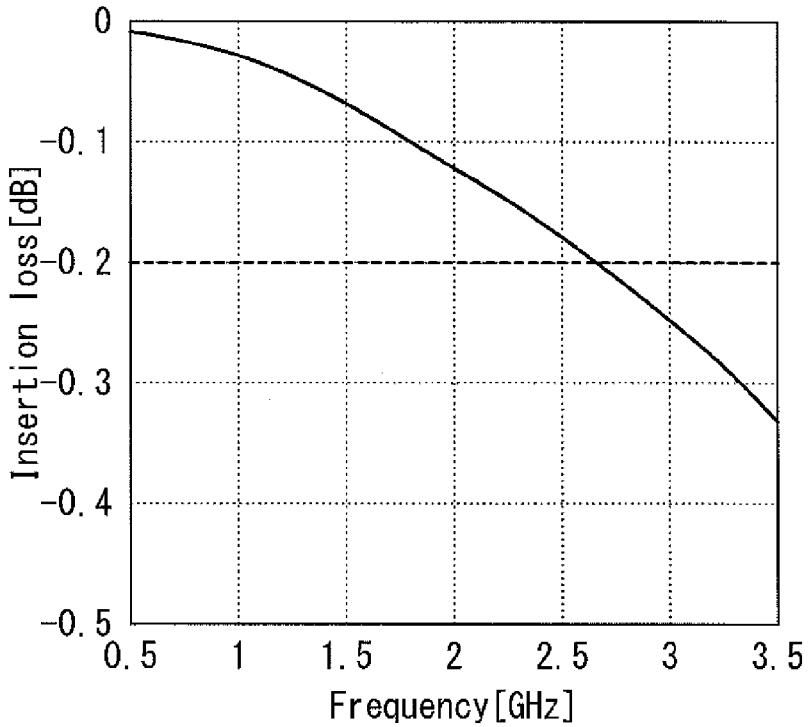
FIG. 18 is a characteristic diagram showing the frequency response of the insertion loss of the directional coupler according to the third embodiment of the invention.
Figure 19:
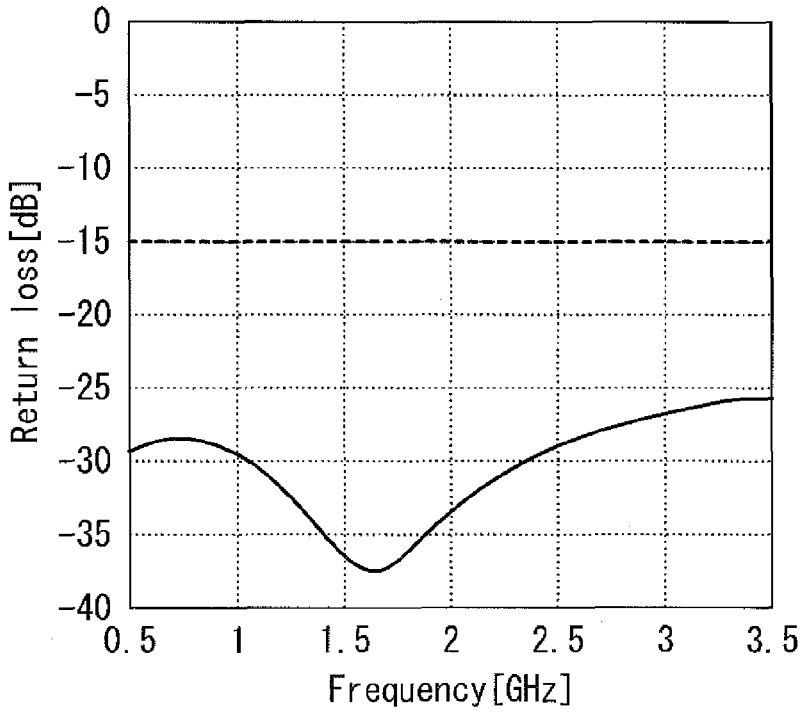
FIG. 19 is a characteristic diagram showing the frequency response of the return loss at the coupling port of the directional coupler according to the third embodiment of the invention.

An example of characteristics of the directional coupler 1 according to the third embodiment will now be described with reference to FIG. 17 to FIG. 19. FIG. 17 is a characteristic diagram showing the frequency response of the coupling of the directional coupler 1. FIG. 18 is a characteristic diagram showing the frequency response of the insertion loss of the directional coupler 1. FIG. 19 is a characteristic diagram showing the frequency response of the return loss at the coupling port 13 of the directional coupler 1. In each of FIG. 17 to FIG. 19 the horizontal axis represents frequency. The vertical axes in FIG. 17, FIG. 18, and FIG. 19 represent coupling, insertion loss, and return loss at the coupling port 13, respectively.

According to the frequency response of the coupling shown in FIG. 17, the difference between the minimum value and the maximum value of the coupling in the service frequency band of the directional coupler 1 (0.7 to 2.7 GHz) is approximately 3 dB, which indicates that variations in coupling are sufficiently suppressed.

The frequency response of the insertion loss shown in FIG. 18 indicates that, where the insertion loss is denoted as −x (dB), the value of x in the 0.7- to 2.7-GHz band is larger than in the first and second embodiments. This shows that the first and second embodiments are able to achieve a smaller value of x when compared with the third embodiment.

The frequency response of the return loss at the coupling port 13 shown in FIG. 19 indicates that, where the return loss is denoted as −r (dB), the value of r in the 0.7- to 2.7-GHz band is 15 or above, which is sufficiently large.

Figure 20:
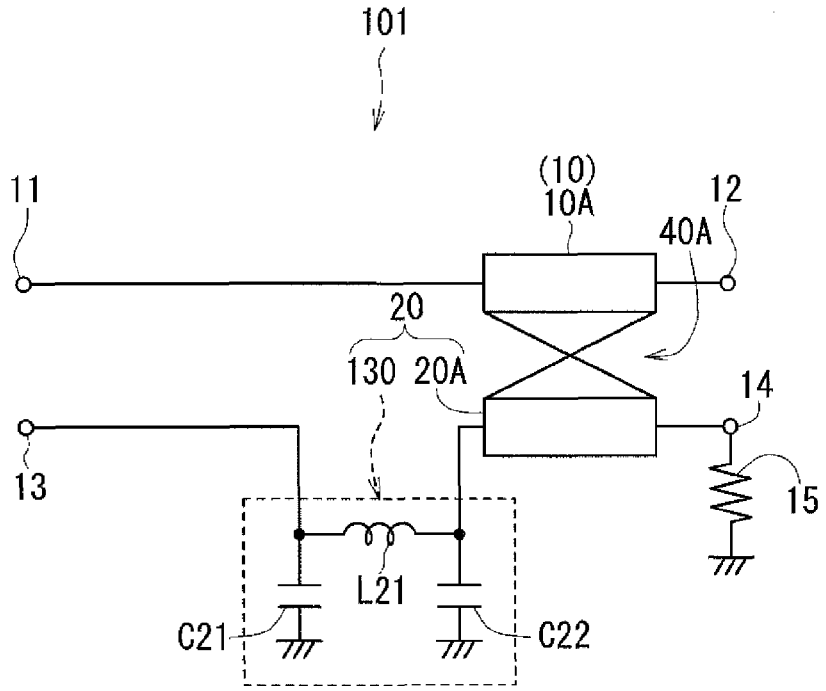
FIG. 20 RELATED ART
FIG. 20 is a circuit diagram showing the circuit configuration of a directional coupler of a comparative example.

Now, the effects of the directional coupler 1 according to the third embodiment will be described in more detail in comparison with a directional coupler of a comparative example. First, the circuit configuration of the directional coupler 101 of the comparative example will be described with reference to FIG. 20. The directional coupler 101 of the comparative example includes a low-pass filter 130 in place of the low-pass filter 30 of the third embodiment.

The low-pass filter 130 includes an inductor L21 provided between the first coupling line section 20A and the coupling port 13, a capacitor C21 connecting the connection point between the inductor L21 and the coupling port 13 to the ground, and a capacitor C22 connecting the connection point between the inductor L21 and the first coupling line section 20A to the ground. The low-pass filter 130 does not include the resistor R1. The remainder of configuration of the directional coupler 101 of the comparative example is the same as that of the directional coupler 1 according to the third embodiment.

Figure 21:
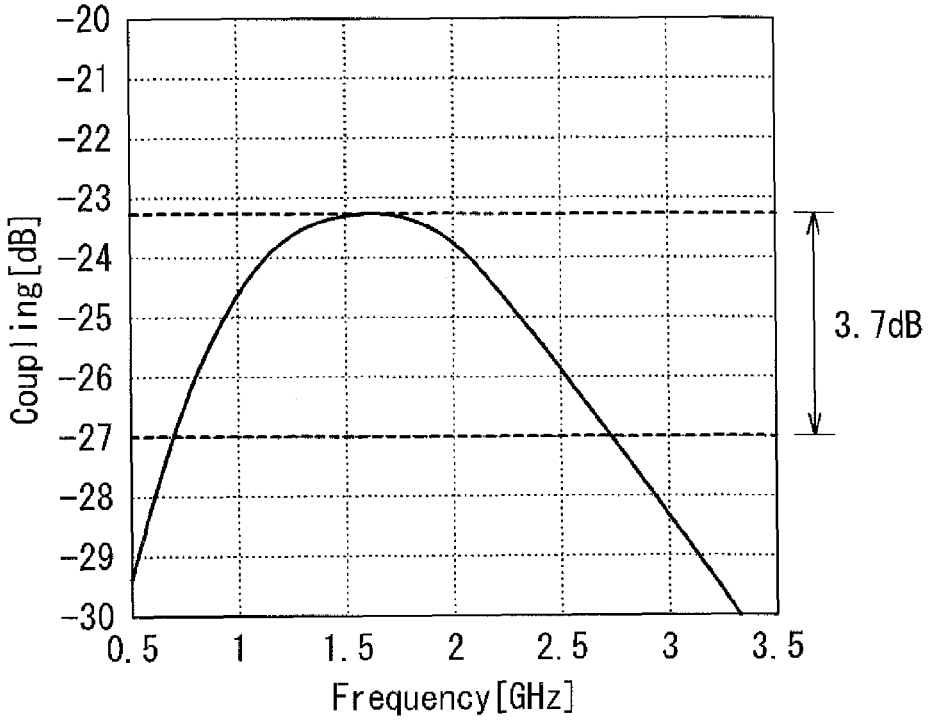
FIG. 21 RELATED ART
FIG. 21 is a characteristic diagram showing the frequency response of the coupling of the directional coupler of the comparative example.
Figure 22:
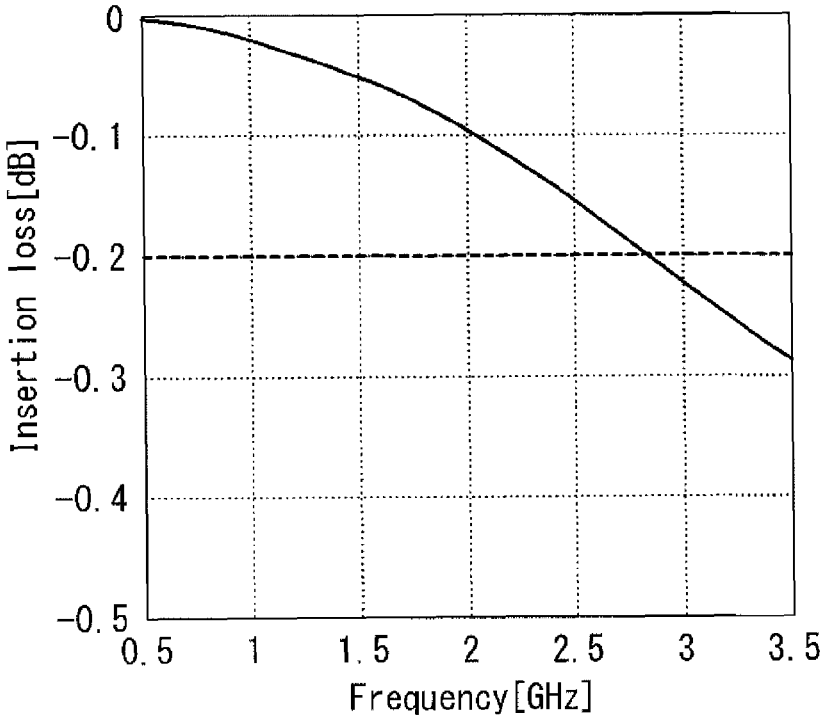
FIG. 22 RELATED ART
FIG. 22 is a characteristic diagram showing the frequency response of the insertion loss of the directional coupler of the comparative example.
Figure 23:
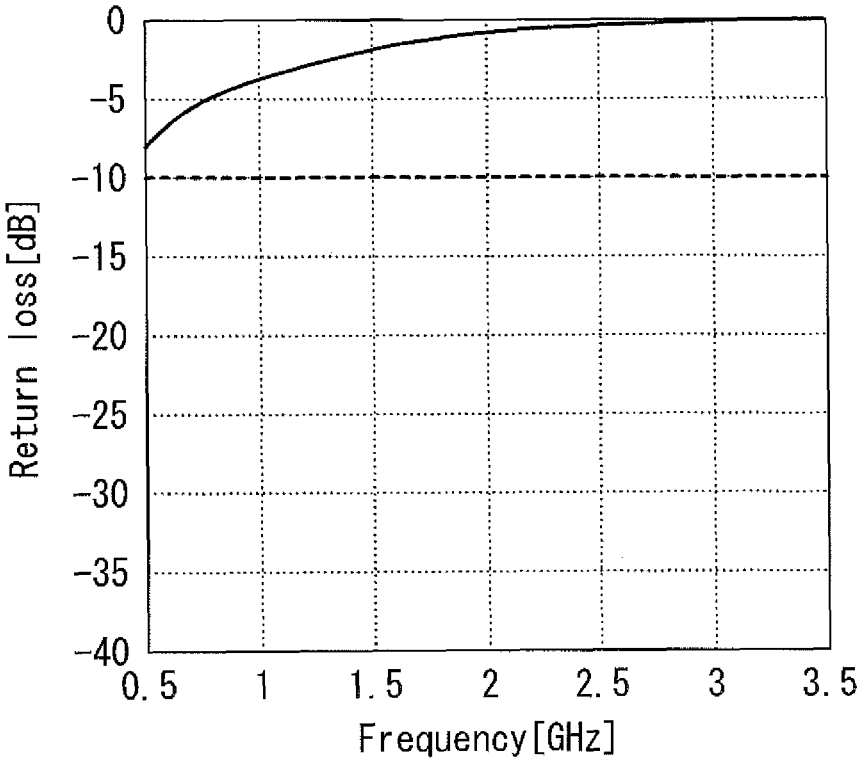
FIG. 23 RELATED ART
FIG. 23 is a characteristic diagram showing the frequency response of the return loss at the coupling port of the directional coupler of the comparative example.

FIG. 21 is a characteristic diagram showing the frequency response of the coupling of the directional coupler 101. FIG. 22 is a characteristic diagram showing the frequency response of the insertion loss of the directional coupler 101. FIG. 23 is a characteristic diagram showing the frequency response of the return loss at the coupling port 13 of the directional coupler 101. In each of FIG. 21 to FIG. 23 the horizontal axis represents frequency. The vertical axes in FIG. 21, FIG. 22, and FIG. 23 represent coupling, insertion loss, and return loss at the coupling port 13, respectively.

According to the frequency response of the coupling shown in FIG. 21, the difference between the minimum value and the maximum value of the coupling in the service frequency band of the directional coupler 101 (0.7 to 2.7 GHz) is approximately 3.7 dB, which is larger than in the case of the directional coupler 1 according to the third embodiment shown in FIG. 17.

The frequency response of the insertion loss shown in FIG. 22 indicates that, where the insertion loss is denoted as −x (dB), the value of x in the 0.7- to 2.7-GHz band is slightly smaller than in the case of the directional coupler 1 according to the third embodiment, but larger than in the first and second embodiments.

The frequency response of the return loss at the coupling port 13 shown in FIG. 23 indicates that, where the return loss is denoted as −r (dB), the value of r in the 0.7- to 2.7-GHz band is smaller than 10, which is insufficient in magnitude.

The directional coupler 1 according to the third embodiment and the directional coupler 101 of the comparative example are greatly different in the frequency response of the return loss at the coupling port 13 (see FIG. 19 and FIG. 23). It is apparent that when compared with the directional coupler 101 of the comparative example, the directional coupler 1 according to the third embodiment is able to reduce signal reflection at the coupling port 13. This is the advantage resulting from the inclusion of the resistor R1 in the low-pass filter 30 of the directional coupler 1 according to the third embodiment. This advantage applies also to the first and second embodiments.

The remainder of configuration, function and effects of the third embodiment are similar to those of the first embodiment.

The present invention is not limited to the foregoing embodiments, and various modifications may be made thereto. For example, the configuration of the low-pass filter of the present invention is not limited to that illustrated in each embodiment, and can be modified in various ways as far as the requirements of the appended claims are met.

Obviously, many modifications and variations of the present invention are possible in the light of the above teachings. Thus, it is to be understood that, within the scope of the appended claims and equivalents thereof, the invention may be practiced in other than the foregoing most preferable embodiments.

What is claimed is:

1. A directional coupler comprising:

an input port;

an output port;

a coupling port;

a terminal port;

a main line connecting the input port and the output port; and a subline connecting the coupling port and the terminal port, wherein the subline includes a first coupling line section and a low-pass filter, the first coupling line section being configured to be electromagnetically coupled to the main line, the first coupling line section has a first end and a second end opposite to each other, the first end is connected to the terminal port, the low-pass filter includes a first path provided between the coupling port and the second end of the first coupling line section, and a second path connected to the first path, the first path has a third end and a fourth end opposite to each other, the third end being connected to the second end of the first coupling line section, the first path including at least one inductor provided between the third end and the fourth end, and the second path includes a first capacitor and a resistor, the first capacitor having two ends, one of the two ends being connected to the fourth end of the first path, the resistor connecting the other of the two ends of the first capacitor to a ground.

2. The directional coupler according to claim 1, wherein the low-pass filter further includes a second capacitor connecting the third end of the first path to the ground.

3. The directional coupler according to claim 1, wherein the subline further includes a second coupling line section configured to be electromagnetically coupled to the main line, the second coupling line section has a fifth end and a sixth end opposite to each other, the fifth end is connected to the coupling port, and the sixth end is connected to the fourth end of the first path.

4. The directional coupler according to claim 1, wherein the first path includes, as the at least one inductor, a first inductor and a second inductor connected in series, and the low-pass filter further includes a third capacitor connecting a connection point between the first inductor and the second inductor to the ground.

5. The directional coupler according to claim 1, wherein the resistor has a resistance in the range of 20 to 90Ω.

* * * * *